US009334602B2

(12) United States Patent
Hasse et al.

(10) Patent No.: US 9,334,602 B2
(45) Date of Patent: May 10, 2016

(54) WATER-CARRYING HOUSEHOLD APPLIANCE HAVING AN AUTOMATIC DOSING SYSTEM, AND METHOD FOR AUTOMATIC DOSING

(75) Inventors: Torsten Hasse, Nauen (DE); Andre Sabalat, Berlin (DE); Ingo Schulze, Panketal (DE)

(73) Assignee: BSH HAUSGERÄTE GMBH, Munich (DE)

( * ) Notice: Subject to any disclaimer, the term of this patent is extended or adjusted under 35 U.S.C. 154(b) by 1074 days.

(21) Appl. No.: 13/119,531

(22) PCT Filed: Sep. 30, 2009

(86) PCT No.: PCT/EP2009/062698
§ 371 (c)(1), (2), (4) Date: Mar. 17, 2011

(87) PCT Pub. No.: WO2010/040674
PCT Pub. Date: Apr. 15, 2010

(65) Prior Publication Data
US 2011/0186098 A1 Aug. 4, 2011

(30) Foreign Application Priority Data
Oct. 7, 2008 (DE) ..... 10 2008 042 655

(51) Int. Cl.
*D06F 39/02* (2006.01)

(52) U.S. Cl.
CPC ..... *D06F 39/022* (2013.01)

(58) Field of Classification Search
CPC ..... D06F 39/022; D06F 39/02; A47L 15/44–15/449
USPC ..... 134/56 R
See application file for complete search history.

(56) References Cited

U.S. PATENT DOCUMENTS

| | | | | |
|---|---|---|---|---|
| 5,240,019 | A * | 8/1993 | Rings | 134/100.1 |
| 5,704,380 | A * | 1/1998 | Zelniker et al. | 134/95.3 |
| 7,845,361 | B1 * | 12/2010 | Verespej et al. | 134/99.2 |
| 2002/0088502 | A1 * | 7/2002 | Van Rompuy et al. | 141/1 |
| 2007/0163307 | A1 * | 7/2007 | Kramme | D06F 39/02 68/17 R |
| 2010/0000022 | A1 * | 1/2010 | Hendrickson et al. | 8/137 |
| 2010/0000264 | A1 * | 1/2010 | Luckman et al. | 68/4 |
| 2010/0147340 | A1 | 6/2010 | Hasse et al. | |
| 2010/0186461 | A1 | 7/2010 | Hasse et al. | |

FOREIGN PATENT DOCUMENTS

| | | | |
|---|---|---|---|
| CN | 1185500 | A | 6/1998 |
| DE | 8033429.8 | U1 | 5/1982 |
| DE | 3302891 | A1 | 5/1984 |
| DE | 3403628 | A1 | 8/1985 |

(Continued)

OTHER PUBLICATIONS

Report of Examination EA 201170487/13, (Aug. 20, 2012).

*Primary Examiner* — Jason Ko
*Assistant Examiner* — Spencer Bell
(74) *Attorney, Agent, or Firm* — Nixon & Vanderhye P.C.

(57) ABSTRACT

A water-carrying household appliance is provided that has a housing; a treatment chamber; and an automatic dosing system within the housing. The automatic dosing system has a reservoir for a liquid treatment agent and a delivery pump within the reservoir. The household appliance further includes a controller to control the automatic dosing system.

39 Claims, 3 Drawing Sheets

(56) References Cited

FOREIGN PATENT DOCUMENTS

| | | | |
|---|---|---|---|
| EP | 1215329 | A2 | 6/2002 |
| EP | 1884584 | A2 | 2/2008 |
| EP | 1959045 | A1 | 8/2008 |
| GB | 2134078 | A | 8/1984 |

* cited by examiner

WATER-CARRYING HOUSEHOLD APPLIANCE HAVING AN AUTOMATIC DOSING SYSTEM, AND METHOD FOR AUTOMATIC DOSING

BACKGROUND OF THE INVENTION

The present invention relates to a water-carrying household appliance having an automatic dosing system.

Modern water-carrying household appliances, in particular washing machines, increasingly use liquid treatment agents as, unlike powdered detergents, these cannot clump and it is easier to tailor their quantities to the various washing tasks. However liquid treatment agents have the drawback that they are more difficult to contain in the containers provided for them. Conventional washing machines have what are known as dispenser trays that are provided to be filled manually with powder-type treatment agents. These have a base and side walls but no rear wall so that water can enter and flush out the dispenser trays. The fresh water supply for the washing machine is generally routed by way of the dispenser trays so that powdered detergent contained therein is only flushed into the tub when the water enters. Liquid treatment agents in contrast would start to run out before this is intended and expedient. Therefore dispenser trays for the generally liquid fabric conditioner are provided with a suction lift apparatus, which only allows the fabric conditioner to be flushed in when the water enters the fabric conditioner tray.

Possible dosing systems have also already been proposed which avoid introduction into the conventional dispenser tray, e.g. dosing containers positioned directly in the drum near the laundry.

As well as solutions for manual dosing attempts have also been made in the prior art to provide automatic dosing for liquid treatment agents to avoid incorrect dosing by the user. So for example DE 80 33 429 U1 and DE 33 02 891 A1 respectively disclose a supply device for a washing machine, containing reservoirs for different treatment agent components. However this solution is disadvantageous in so far as it takes up additional space as the supply device can only be arranged adjacent to the washing machine.

A washing machine has recently been brought onto the market that can be supplied automatically with treatment agents by way of a separate reservoir for treatment agents to be positioned on the washing machine and a dosing facility arranged outside the container (see DE 100 62 111 C1). Such a separate container however also takes up space and the long hoses required are problematic as they can become blocked by viscous detergent.

Washing machines with a drawer in the lower region of the appliance are known from EP 1 884 584 A2, with space being provided for treatment agent reservoirs therein. However since space is very limited in a washing machine, this is only feasible with an additional base or a modification of the external dimensions of the appliance, which in turn has the same drawbacks as the solution with the supply device.

BRIEF SUMMARY OF THE INVENTION

The object of the present invention was therefore to provide a household appliance that at least partially eliminates the drawbacks of the prior art.

The object is achieved by a water-carrying household appliance having a housing and a treatment chamber and an automatic dosing system which is arranged within the housing and which can be controlled by way of a control unit, the dosing system comprising at least one reservoir and at least one delivery pump arranged within the reservoir.

The invention is based on the external dimensions of a currently standard water-carrying household appliance but is not restricted to such. The water-carrying household appliance is preferably a washing machine or a washer-dryer but the invention is also suited to dishwashers or other cleaning appliances for example, for which the automatic dosing of liquid treatment agents is appropriate.

In one particularly preferred embodiment the water-carrying household appliance is a front-loader washing machine. Such a front-loader washing machine in its conventional, non-inventive form has what is known as a dispenser drawer generally containing two to four manual dispenser trays. The drawer is located in the upper region of the washing machine behind a panel part. Since the manual dispenser trays do not take up all the available space, in one preferred embodiment the inventive dosing system can be arranged in this region and utilize said space.

The inventive dosing system comprises at least one, preferably at least two, reservoir(s). However more than two reservoirs can also be present if a number of types of treatment agent are to be supplied, e.g. two or four or even more. It is advantageous if a number of reservoirs are present, since then a number of treatment agents can be stored and dosed in. For example washing agent components such as enzymes, bleaches, detergents, etc. can be dosed separately or various ready-made cleaning agents may be available, e.g. standard detergents, fabric conditioners, wool detergents, special detergents for black laundry and the like.

If the reservoirs are in the dispenser drawer of a washing machine, their dimensions are preferably tailored to this. In one particularly advantageous embodiment the drawer is lengthened to the rear and extends to the rear wall of the appliance.

The dosing system expediently also contains at least one manual dosing chamber or dispenser drawer—optionally in addition to the reservoirs. When the dosing system is arranged in the dispenser drawer of a washing machine, it is advantageous if the reservoir(s) is/are arranged in the rear region and the at least one manual dispenser tray in the front region.

The dosing system is preferably arranged in a detachable manner within the appliance and can be removed from said appliance. It is advantageous but not absolutely necessary for the dosing system as a whole to be removable but it is particularly advantageous for the reservoirs to be removable. This allows the reservoirs to be cleaned easily. The capacity for removal can be realized in various ways. In the case of a washing machine or washer-dryer equipped with a dispenser drawer, the reservoirs are preferably in the drawer. Said drawer then preferably has roughly the dimensions of a condensation tank of a tumble dryer and can be pulled out to some degree or even completely removed. It is sufficient to pull the drawer out only partially to fill the reservoirs. It is also possible for the reservoirs themselves to be able to be removed separately from the drawer.

The reservoirs are preferably configured so that they can be filled manually. For example they can have a fill opening on their top side or can also be closed with a lid. The lid is also preferably detachable and removable. The lid can be provided with latching elements which allow it to be secured to the reservoirs. The reservoirs preferably also comprise a drain opening for removing liquid treatment agents if they are added in error.

At least one delivery pump for liquid treatment agent is arranged within the reservoir in each instance. This is configured particularly in such a manner that it is immersed in the medium present in the reservoir in order to deliver it. The use of submersible pumps, which are arranged directly in the reservoir and able to be immersed in the treatment agent, is advantageous as there is then absolutely no need for hose connections. This facilitates maintenance and simplifies assembly.

The suction side of such a delivery pump, in particular a submersible pump, is expediently arranged on the base of the respective reservoir as far as is structurally possible. The delivery side of the delivery pump is preferably outside the reservoir. It is particularly preferable in a washing machine for the delivery pump to deliver directly into a flushable outlet duct so that the delivered treatment agent can be flushed in together with water thereby arriving diluted at the laundry.

The type of delivery pump is not significant but it is preferably a gear pump. The delivery pump is controlled and supplied with power by way of an electrical contact.

A removable lid is preferably provided for the reservoir, in which the lines in particular run. Such a lid is preferably configured in such a manner that the at least one delivery pump is connected to it.

The at least one delivery pump is preferably secured in the reservoir in a detachable and removable manner. It can be fitted on a reservoir wall in the reservoir. It is particularly preferable for it to be secured below the lid, so that the line contacts are above the level of the liquid where possible. The delivery pump can be fitted by way of latches or other detachable fastenings or can even be secured in a non-detachable manner, e.g. by sticking, welding or the like.

Power is supplied to the at least one delivery pump by way of contacts preferably on the top side of a delivery pump and by way of lines, which are expediently passed along the top side of the reservoir. The lines are preferably arranged in the lid. This has the advantage that they can be protected from moisture.

The at least one delivery pump is preferably linked to a control unit that controls all the delivery pumps and which in one advantageous embodiment can also calculate the quantity to be dosed and drives the delivery pump accordingly.

The present invention further relates to a method for the automatic dosing of treatment agent in a water-carrying household appliance of the type described above, the method comprising the following steps:

i) determining the type and a desired quantity of treatment agent to be dosed, ii) driving a delivery pump assigned to the treatment agent to be dosed, iii) determining a supplied actual quantity of the treatment agent to be dosed during step ii), iv) comparing the actual quantity of treatment agent supplied with the desired quantity determined in step i), v) switching off the delivery pump when the desired quantity determined in step i) is reached.

As mentioned above, the delivery pumps feature a rotating delivery unit, and are particularly preferably gear pumps. These have the advantage that the delivered volumes can be easily controlled.

Determination of the desired quantity of treatment agent is known per se and is a function of various parameters, e.g. load, type of laundry, type of wash program selected, water hardness, degree of soiling and the like. Once the desired quantity of treatment agent has been determined, the delivery pump is driven. In this process the pump is preferably operated at a fixed voltage and the delivered quantity over time is controlled. However the delivered quantity can also be varied in a different manner, e.g. by the speed of the drive.

The actual quantity of treatment agent is preferably detected by measuring the rotations of the delivery unit of the delivery pump. Alternatively or additionally the actual quantity can also be derived from the number of rotations of the pump drive. It is particularly preferable for the delivery pump to have a direct current drive so that it is possible also to measure the number of rotations of a direct current drive to detect the actual quantity of treatment agent. The direct current drive preferably operates with an electric voltage from the low-voltage range, in particular with an electric voltage between 3 volts and 15 volts. A further possibility is to determine the number of rotations of the pump drive from the signal profile of the drive. This has the major advantage that no additional sensors are required.

The actual quantity of treatment agent supplied is detected a number of times for example and this value is compared with the desired value until the actual value has reached the desired value. The delivery pump is then switched off. The comparisons are carried out by a control unit arranged in the appliance.

BRIEF DESCRIPTION OF THE DRAWINGS

Exemplary embodiments of the invention are described in more detail below based on drawings with the following views.

DETAILED DESCRIPTION OF EXEMPLARY EMBODIMENTS OF THE PRESENT INVENTION

Figure 1:
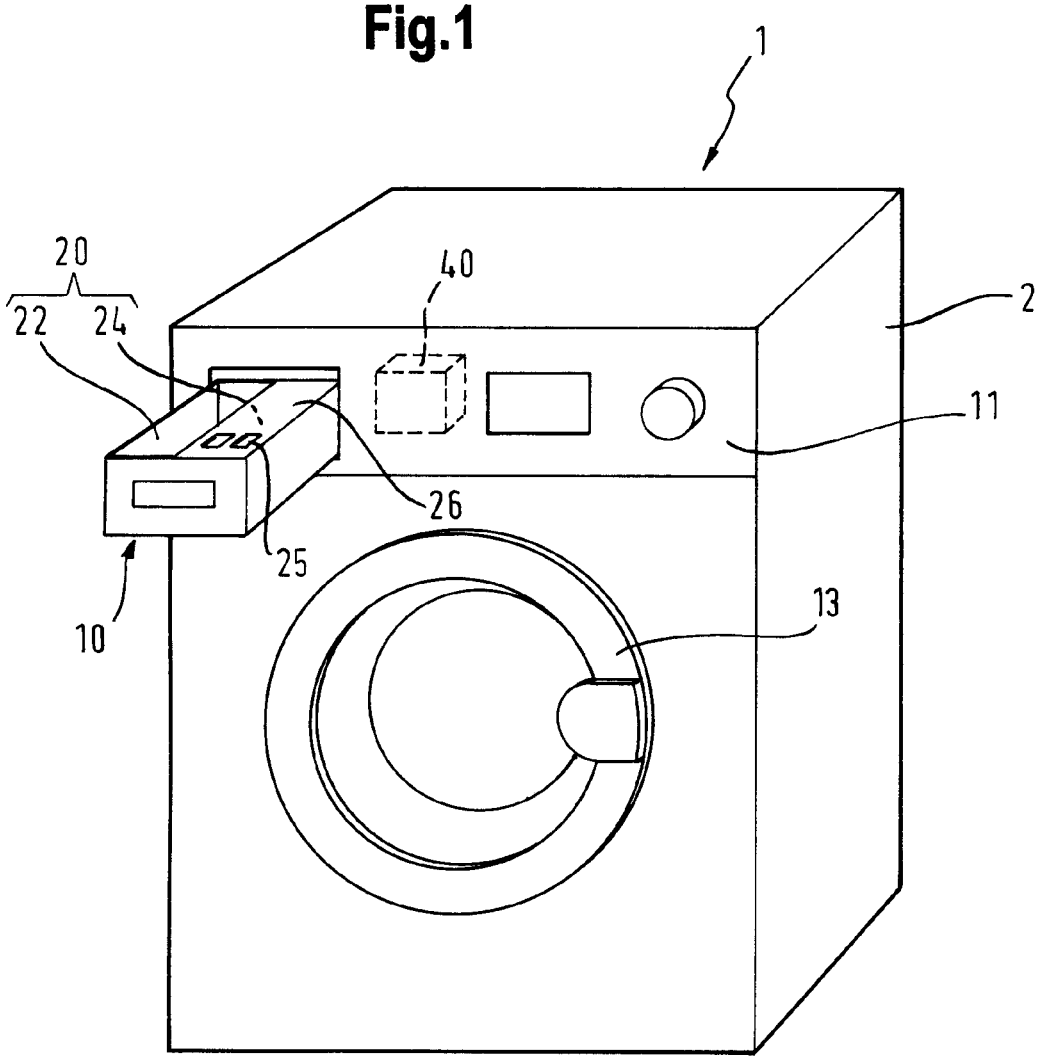
FIG. 1 shows a perspective view of a washing machine.

FIG. 1 shows a washing machine 1 having a housing 2, a door 13 and a detergent drawer 10 in the upper left region of the panel 11. The drawer 10 is shown partly pulled out and reveals a manual dosing chamber 22 arranged on the left and reaching to the panel part, as well as two reservoirs 24 with fill openings 25 in the lid 26. In this exemplary embodiment both reservoirs 24 are covered by a shared detachably arranged lid 26. The user can introduce quite a large quantity of treatment agent into the reservoir 24 through the fill openings 25.

Also shown with a broken line is a control unit 40, which controls the immersion pumps 30 serving as delivery pumps 30 here and monitors the delivered quantity. The control unit 40 is provided by the usual sensors with information about soiling, load, type of laundry and the like and uses this to calculate the optimum dose for the respective treatment agent, which is then delivered and dosed precisely by immersion pumps 30.

Figure 2:
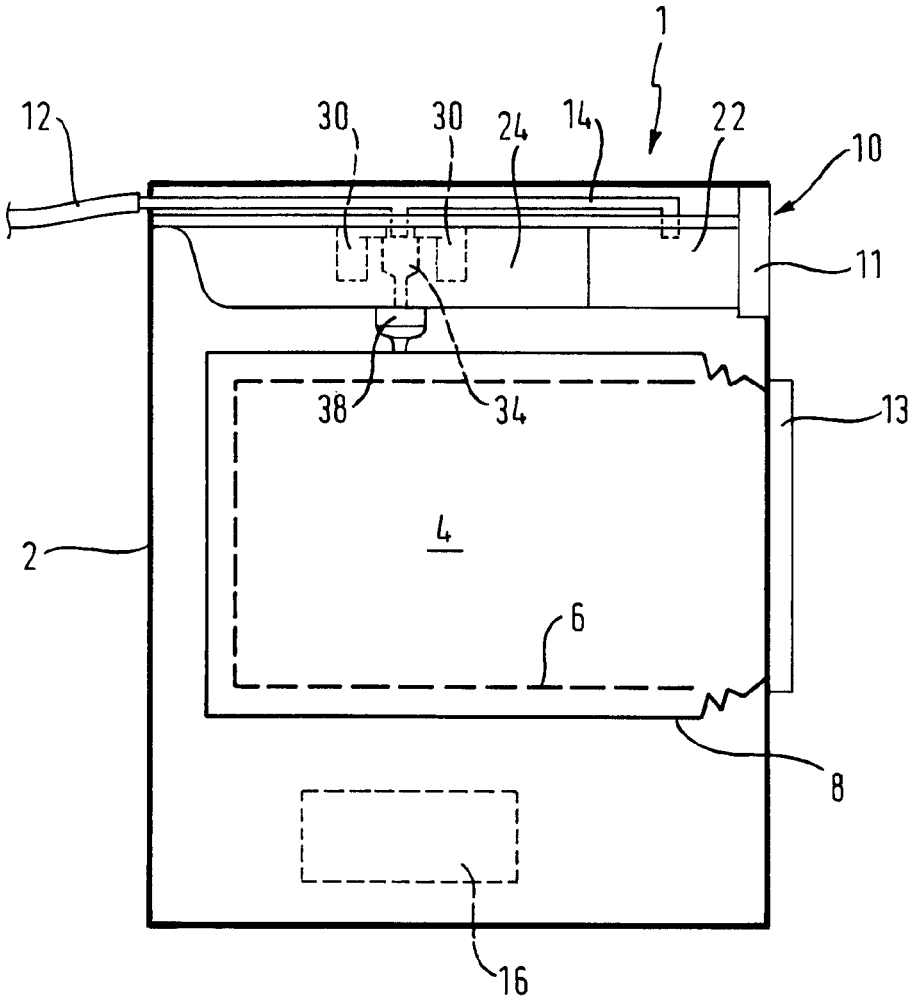
FIG. 2 shows the same washing machine as in FIG. 1 but schematically and in a sectional side view.

FIG. 2 shows the washing machine 1 from FIG. 1 but in a sectional side view. This clearly shows the elongation and extension of the reservoirs 24 to the rear wall of the appliance. The immersion pumps 30 in the interior of the reservoirs 24 are shown with a broken line. The flush-in line 14 is above the drawer 10, supplying both the manual dosing chamber 22 and an outlet duct 34 for the reservoirs 24 with fresh water from a freshwater supply line 12. The two immersion pumps 30 both deliver into the outlet duct 34, which opens into an inlet hose 38, which is connected directly to the tub 8.

The washing machine further comprises conventional equipment features such as a laundry drum 6, which is mounted in a rotatable manner in a tub 8 and can be closed off with the door 13. The treatment chamber 4 is thus within the tub. The drum 6 is driven by way of the drive motor 16.

Figure 3:
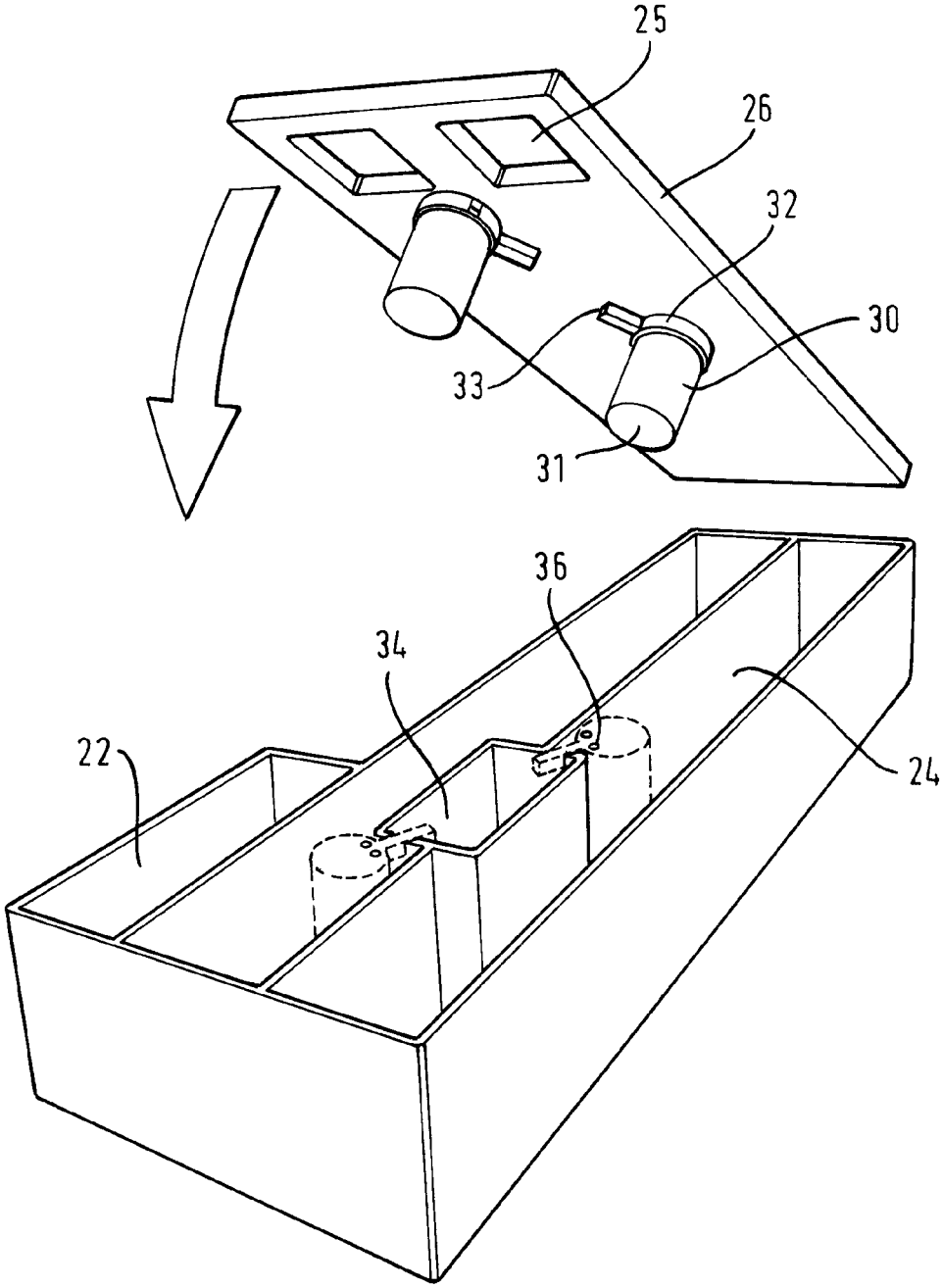
FIG. 3 shows a perspective view from above of a part of the dosing system comprising a dispenser drawer with a manual dosing chamber and two reservoirs with immersion pumps. It also shows a perspective view of the inside of a lid for the dosing system.

FIG. 3 shows details of the dosing system 20. In this embodiment it comprises a manual dosing chamber 22 and two reservoirs 24 connected thereto as a single injection-molded piece. These are shown without an upper wall, as a separate removable lid 26 is provided. The immersion pumps 30 are represented with a broken line in the diagram of the dosing system 20, to show their position in the interior of the reservoirs 24. The immersion pumps 30 are secured directly to the lid 26 in the diagram of the lid 26. The two immersion pumps 30 both deliver into an outlet duct 34. In this embodiment only a single outlet duct 34 is provided for both immersion pumps 30. This has the advantage that the flush-in line 14 can be configured in a simple manner. In the embodiment shown the immersion pumps 30 each have two contacts 36 on their top sides. These are used to control the pump drive (not shown in a visible manner) by way of lines (also not shown) running in the lid 26. The immersion pumps 30 each have an outlet 33 on the delivery side 32, which opens into the outlet duct.

LIST OF REFERENCE CHARACTERS

1 Water-carrying household appliance, washing machine
2 Housing
4 Treatment chamber
6 Laundry drum
8 Tub
10 Treatment agent drawer
11 Panel
12 Fresh water supply line
14 Flush-in line
13 Door
16 Drive motor for laundry drum
20 Dosing system
22 Manual dosing chamber
24 Reservoir
25 Fill opening
26 Lid of reservoir
30 Delivery pump, immersion pump
31 Suction side
32 Delivery side
33 Outlet
34 Outlet duct for reservoir
36 Pump contact
38 Inlet hose
40 Control unit

The invention claimed is:

1. A water-carrying household appliance, comprising:
a housing;
a treatment chamber within the housing;
a manual dosing chamber a) in fluid communication with the treatment chamber and b) located within the housing, wherein the manual dosing chamber does not include a pump;
an automatic dosing system a) in fluid communication with the treatment chamber and b) located within the same region of the housing as the manual dosing chamber, the automatic dosing system having:
a reservoir for a liquid treatment agent;
a removable lid configured to cover an entirety of the reservoir;
a delivery pump supported by the lid so that the delivery pump is removable with the lid, an exterior of the delivery pump being configured to be in direct contact with the liquid treatment agent in the reservoir; and
a controller to control the automatic dosing system,
wherein the manual dosing chamber and the automatic dosing system are located in a common dispensing drawer.

2. The water-carrying household appliance of claim 1, wherein the automatic dosing system comprises the manual dosing chamber.

3. The water-carrying household appliance of claim 1, wherein the automatic dosing system has two reservoirs.

4. The water-carrying household appliance of claim 3, wherein the two automatic dosing system reservoirs are fluidly connected to a common outlet duct.

5. The water-carrying household appliance of claim 4, further comprising a water supply line that feeds into the common outlet duct defined by the automatic dosing system reservoirs.

6. The water-carrying household appliance of claim 3, wherein the removable lid is configured to cover an entirety of both automatic dosing system reservoirs.

7. The water-carrying household appliance of claim 1, wherein the automatic dosing system is arranged in a detachable manner within the housing, and wherein the automatic dosing system is removable from the housing.

8. The water-carrying household of claim 1, wherein the delivery pump is arranged in a detachable manner within the reservoir, and wherein the delivery pump is removable from the reservoir.

9. The water-carrying household appliance of claim 1, wherein the delivery pump is an immersion pump.

10. The water-carrying household appliance of claim 1, further comprising a plurality of delivery pumps, wherein each of the plurality of delivery pumps is removable individually.

11. The water-carrying household appliance of claim 1, wherein the household appliance is a washing machine having a treatment agent drawer, and wherein the automatic dosing system is in the treatment agent drawer.

12. The water-carrying household appliance of claim 11, wherein the automatic dosing system comprises the manual dosing chamber and two reservoirs.

13. The water-carrying household appliance of claim 1, wherein the delivery pump has a suction side, which is positioned in the interior of the reservoir, and a delivery side, which opens into an outlet duct.

14. The water-carrying household appliance of claim 1, wherein the delivery pump is a gear pump.

15. The water-carrying household appliance of claim 1, wherein the delivery pump has a direct current drive.

16. The water-carrying household appliance of claim 15, wherein the direct current drive is operated in a low-voltage range.

17. The water-carrying household appliance of claim 1, wherein the reservoir defines a continuous space and is configured to hold the liquid treatment agent.

18. The water-carrying household appliance of claim 17, wherein the automatic dosing system further comprises a lid configured to cover the reservoir, the lid having a fill opening.

19. The water-carrying household appliance of claim 18, wherein the delivery pump is configured to convey the liquid treatment agent to an outlet duct in communication with the treatment chamber.

20. The water-carrying household appliance of claim 19, wherein the automatic dosing system comprises a plurality of reservoirs, and at least two reservoirs are in communication with the outlet duct.

21. The water-carrying household appliance of claim 20, wherein the automatic dosing system comprises a plurality of delivery pumps, each pump being associated with a corresponding one of said plurality of reservoirs.

22. The water-carrying household appliance of claim 21, wherein an exterior of each of said plurality of delivery pumps is configured to be in direct contact with the liquid treatment agent.

23. The water-carrying household appliance of claim 21, wherein each of said plurality of delivery pumps is suspended from an underside of the removable lid.

24. The water-carrying household appliance of claim 22 further comprising a water supply line in communication with the outlet duct.

25. The water-carrying household appliance of claim 24, wherein each of said plurality of delivery pumps is fluidly connected to the outlet duct.

26. The water-carrying household appliance of claim 1, further comprising a control panel with a user input and a display, wherein the automatic dosing system is located adjacent the control panel.

27. The water-carrying household appliance of claim 1, wherein the reservoir is distinct from the manual dosing chamber.

28. The water-carrying household appliance of claim 1, wherein the manual dosing chamber is in close proximity to the automatic dosing system.

29. The water-carrying household appliance of claim 1, wherein the manual dosing chamber and the reservoir share a common wall.

30. The water-carrying household appliance of claim 1, wherein the manual dosing chamber is on the same side of the treatment chamber as the reservoir.

31. The water-carrying household appliance of claim 1, wherein a main body of the delivery pump is arranged on a base of the reservoir when the removable lid covers the reservoir.

32. The water-carrying household appliance of claim 1, wherein the delivery pump is supported entirely from the underside of the removable lid.

33. The water-carrying household appliance of claim 1, wherein the removable lid has openings separate from the delivery pump for refilling the reservoir without removing the lid or the delivery pump from the reservoir.

34. The water-carrying household appliance of claim 1, wherein the automatic dosing system further comprises an outlet duct configured to receive a discharge from the delivery pump, and the lid and the delivery pump are configured so that securing the lid to the reservoir automatically aligns an outlet of the delivery pump with the outlet duct.

35. The water-carrying household appliance of claim 1, wherein the common dispensing drawer is located above the treatment chamber.

36. A method for automatic dosing of a treatment agent in a water-carrying household appliance having a housing; a treatment chamber; a manual dosing chamber located within the housing and in fluid communication with the treatment chamber wherein the manual dosing chamber does not include a pump, an automatic dosing system located within the same region of the housing as the manual dosing chamber, wherein the automatic dosing system has a reservoir for a liquid treatment agent, a removable lid configured to cover an entirety of the reservoir, a delivery pump suspended from an underside of the removable lid, an exterior of the delivery pump being configured to be in direct contact with the liquid treatment agent in the reservoir; and a controller to control the automatic dosing system, wherein the manual dosing chamber and the automatic dosing system are located in a common dispensing drawer; the method comprising:

i) determining a type and a desired quantity of the liquid treatment agent to be dosed;

ii) driving the delivery pump assigned to the liquid treatment agent to be dosed;

iii) determining a supplied actual quantity of the liquid treatment agent to be dosed during step ii);

iv) comparing the supplied actual quantity of the liquid treatment agent with the desired quantity determined in step i); and v) switching off the delivery pump when the desired quantity determined in step i) is reached.

37. The method of claim 36, wherein the delivery pump has a rotationally operated delivery unit, and wherein in step iii) the supplied actual quantity of the liquid treatment agent is detected by measuring rotations of the delivery unit of the delivery pump.

38. The method of claim 37, wherein a number of the rotations of a direct current drive is measured in step iii).

39. The method of claim 38, wherein the number of the rotations of a pump drive is determined from a signal profile of the pump drive.

* * * * *